United States Patent [19]

Whitney

[11] 4,453,538

[45] Jun. 12, 1984

[54] MEDICAL APPARATUS

[76] Inventor: John K. Whitney, Lenneys La., Orchard Park, N.Y. 14210

[21] Appl. No.: 208,003

[22] Filed: Nov. 18, 1980

Related U.S. Application Data

[63] Continuation of Ser. No. 1,404, Jan. 8, 1979, abandoned, which is a continuation of Ser. No. 785,408, Apr. 17, 1977, abandoned.

[51] Int. Cl.[3] ..... A61H 1/00

[52] U.S. Cl. ..... 128/24 R; 128/82.1; 128/DIG. 20

[58] Field of Search ..... 128/24 R, 82.1, 38–40, 128/64, 24.1, DIG. 20

[56] References Cited

U.S. PATENT DOCUMENTS

| | | | |
|---|---|---|---|
| 3,701,349 | 10/1972 | Larson | 128/82.1 |
| 3,771,519 | 11/1973 | Haake | 128/DIG. 20 |
| 3,920,006 | 11/1975 | Lapidus | 128/24.1 |
| 4,013,069 | 3/1977 | Hosty | 128/24 R |

*Primary Examiner*—John D. Yasko

*Attorney, Agent, or Firm*—Amster, Rothstein & Engelberg

[57] ABSTRACT

Apparatus for the alleviation of operative and post operative deep venous thrombosis comprises a flexible pad for enwrappment about a mammalian limb such as a human leg. The pad comprises a first plurality of large, individual, fluid receiving pressure cells alternated with a second plurality of smaller, fluid receiving and releasing ventilating cells. Means are included for supplying fluid pressure to the cells.

20 Claims, 13 Drawing Figures

MEDICAL APPARATUS

This application is a continuation of application Ser. No. 1,404 filed Jan. 8, 1979 now abandoned which is a continuation of Ser. No. 785,408 filed Apr. 17, 1977, now abandoned.

BACKGROUND OF THE INVENTION

This invention relates to the alleviation of deep venous thrombosis by mechanical as opposed to chemical means. Deep venous thrombosis (DVT) is a condition in which clotting of venous blood occurs in the lower extremities and pelvis because of the lack of sufficient muscular activity in the lower legs. Such clotting can be life threatening if a blood clot migrates to the heart, lung or brain and interferes with blood circulation. Preventive treatment often employs chemical means, such as anti-coagulants; however, such chemical means are often contra-indicated, for example, in neurological surgery or where the threat of hemmorage is present.

In these latter conditions the prevention of DVT has been attempted by mechanical means employing elastic bandages or stockings or by pneumatic leggings adapted to receive a pressured gas in desired sequence. U.S. Pat. No. 3,892,229 illustrates one form of this type of device and U.S. Pat. No. 3,901,221 illustrates a type of pressured sequence.

While devices such as those shown in U.S. Pat. No. 3,892,229 have been employed successfully, it is believed that problems exist therewith. Such problems arise from the fact that pressure is applied equally and simultaneously throughout the entire limb. It is more preferable to force the blood in the extremities back toward the heart. Devices which apply a uniform overall pressure do not move the blood in a specific direction. Furthermore, these devices are made from rubber or plastic material and are quite hot when worn for long periods of time and no means for providing ventilation exist.

OBJECTS AND SUMMARY OF THE INVENTION

It is therefore, an object of this invention to obviate the disadvantages of the prior art.

It is another object of the invention to provide an effective means for alleviating deep venous thrombosis (DVT).

Yet another object of the invention is the provision of such means which include means for ventilating the area between the device and the limb.

These objects are accomplished in one aspect of the invention by an apparatus for the alleviation of operative and post operative DVT which comprises a flexible pad formed for external enwrappment about a mammalian limb.

The pad comprises a first plurality of relatively large, individual, fluid receiving pressure applying cells and a second plurality of relatively smaller, individual, fluid receiving and releasing ventilating cells arrayed alternately with said first plurality of cells; and means for supplying fluid pressure to said cells.

In operation, the cells of the pad are pressurized sequentially, beginning with the distal cell which encircles, for example, the ankle area of a human leg. An adjacent cell is then pressurized and then another until all cells are pressurized. The entire sequence consumes about ⅓ of a minute or approximately 20 seconds, and then the cells are simultaneously de-pressurized and no pressure is applied for approximately one minute. During the de-pressurized period the gaseous fluid is applied to the ventilating cells for supplying ventilation to the area between the pad and the skin.

This apparatus provides unique improvements over prior art devices in the sequential application of pressure and the ventilation provided during periods of no pressure.

DESCRIPTION OF THE PREFERRED EMBODIMENTS

For a better understanding of the present invention, together with other and further objects, advantages and capabilities thereof, reference is made to the following disclosure and appended claims taken in conjunction with the above-described drawings.

Figure 1:
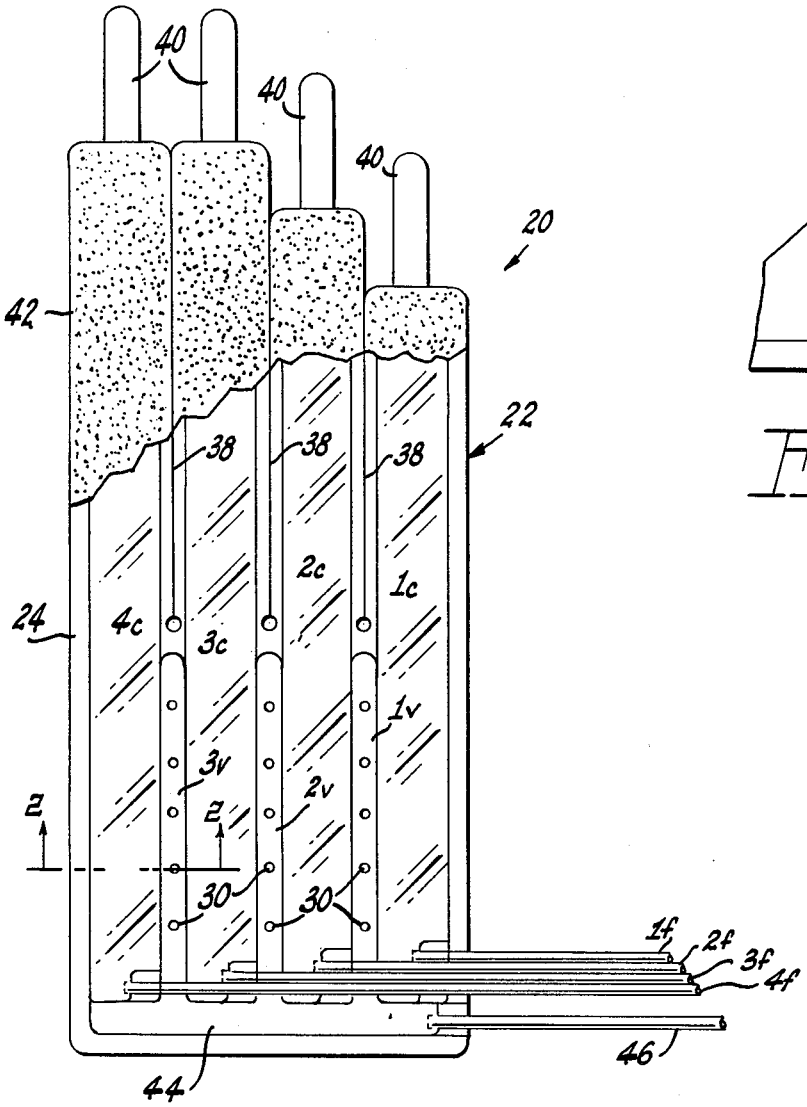
FIG. 1 is a plan view of the apparatus of the invention with some parts broken away and some parts omitted.
Figure 2:
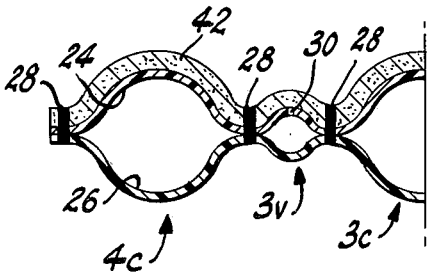
FIG. 2 is a sectional view taken along the line 2—2 of FIG. 1.

Referring now to the drawings with greater particularity, there is shown in FIG. 1 an apparatus 20 for the alleviation of operative and post operative deep venous thrombosis (DVT). Apparatus 20 comprises a flexible pad 22 formed for enwrappment about a mammalian limb, such as a human leg. The pad 22 is formed from two overlying sheets 24, 26 (FIG. 2) of fluid impervious material such as polyethylene or vinyl. A first plurality of cells numbered 1*c*, 2*c*, 3*c* and 4*c* is formed within pad 22 by means of dielectric welding or similar heat sealing techniques so that each cell is a separate entity. The sealed areas are shown at 28 in FIG. 2. Each of the cells 1*c*–4*c* is relatively large.

A second plurality of relatively smaller cells, numbered 1*v*, 2*v* and 3*v*, is also provided within the pad 22, the second plurality of cells being arrayed alternately with the first plurality. Each of the cells of the second plurality is provided with a multiplicity of small apertures 30 for releasing a ventilating fluid, as will be explained hereinafter.

While each of the cells 1*c*–4*c* of the first plurality of cells may be of identical length, in the preferred embodiment illustrated in FIG. 1 the cells are of varying lengths to accommodate the varying circumferences of, for example, a human leg. Thus, in FIG. 1, cell 1*c* has a shorter length for enwrappment about the ankle area, while cells 3*c* and 4*c* are longer to accommodate the greater circumference of the calf. As will also be apparent, the length of all of the cells is greater than the width.

Figure 4:
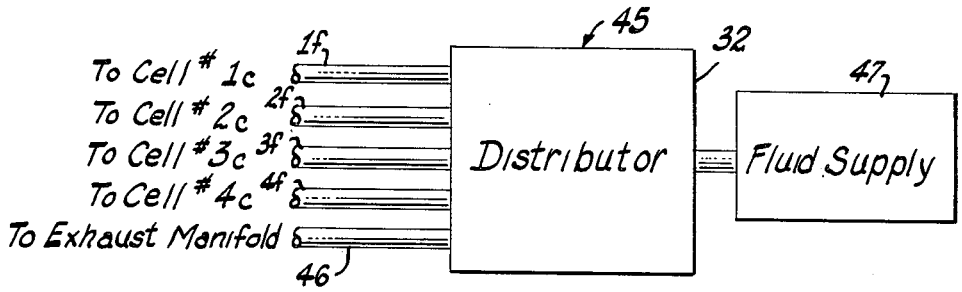
FIG. 4 is a diagrammatic view of the fluid supply.
Figure 5:
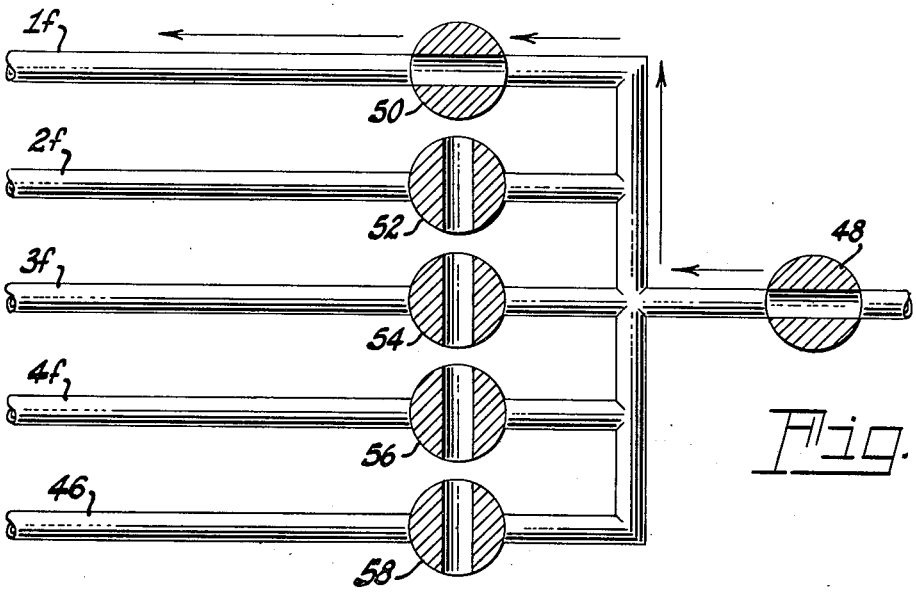
FIGS. 5–9 and 11 are schemmatic representations of the pressurization, exhaust and ventilation sequences.

One end of each of the cells 1*c*–4*c* is formed to receive fluid pressure, which is in the form of a non explosive gas, preferably air. Each of the cells 1*c*–4*c* is fluidly independent from the remaining cells and is provided with fluid inlet and outlet means labeled 1*f*–4*f*, in the form of hoses which have one of their ends sealed into the cell and the other connected to a distributor 32 (FIG. 4).

Figure 3:
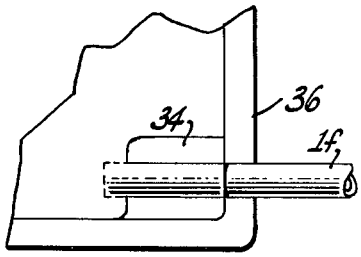
FIG. 3 is a partial, idealized view illustrating the manner of sealing fluid carrying hoses into the cells of the pad.

The hoses are sealed into the cells in a manner illustrated diagrammatically and ideally in FIG. 3. Therein, it will be seen that a hose, for example 1*f*, is heat sealed as at 34 or cemented between the two layers 24 and 28. The heat sealed area 34 blends into the peripheral seal area 36.

The cells 1*c*–4*c* are physically connected together for about ½ their length and are formed as physically separated entities for the other ½ of their length. This is accomplished by forming a cut 38 between the heat sealed areas separating the cells. This separation also aids in wrapping the pad 22 about the varying circumferences of a human leg.

Fastening means 40 are also provided for maintaining the pad 22 in position on the leg and can comprise any suitable means such as Velcro fasteners, a belt and buckle arrangement or a piece of adhesive tape.

The underside or patient side of pad 22 is provided with cushioning material 42 such as foam rubber or a non-woven cloth or similar material. A cellular type material is preferred to aid in the ventilation cycle to be described.

As mentioned above, the large cells 1*c*–4*c* are each independent, however, the second plurality of cells 1*v*–3*v* are all commonly connected together through an exhaust manifold 44, with which the cells 1*v*–3*v* communicate. The exhaust manifold 44 in turn is fed by a hose 46 from distributor 32.

In referring now to FIGS. 4–9 and specifically to FIG. 4 there is shown fluid pressure supply means 45 which comprises a source of fluid pressure 47 such as an air pump which feeds distributor 32 which sequentially feeds pressure cells 1*c*–4*c* and ventilating cells 1*v*–3*v*.

Figure 6:
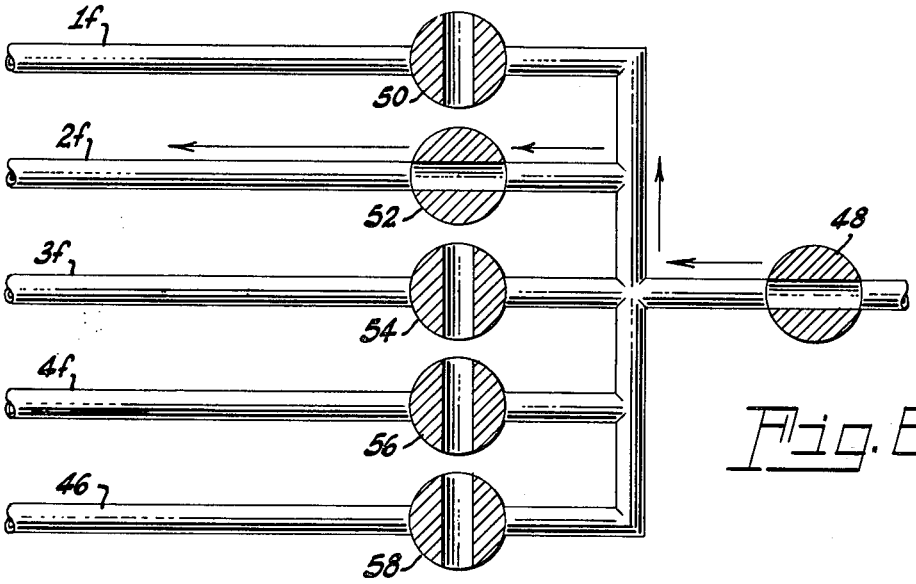
Figure 7:
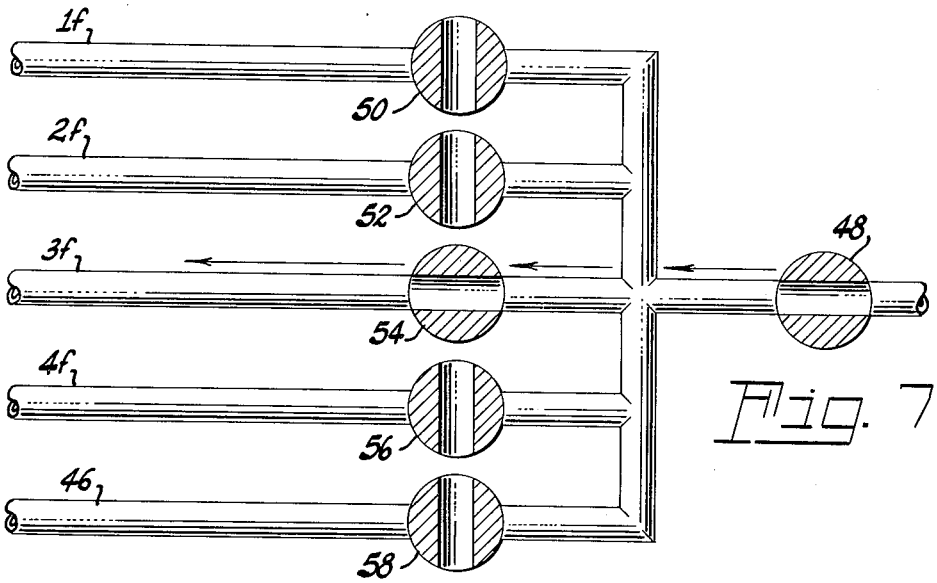
Figure 8:
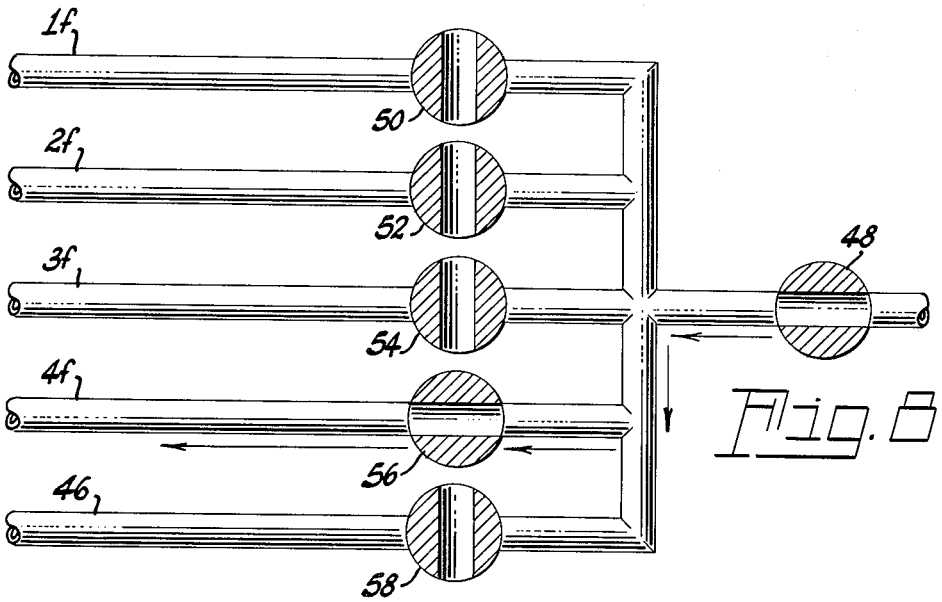

In the diagrammatic representations of FIGS. 5–8 the sequential operation is shown as being controlled by a plurality of valves. Thus, at the beginning of a cycle, valve 48 in fluid supply 47 is open as is valve 50 in hose 1*f* which feeds cell 1*c*. The remaining valves 52, 54, 56 and 58 of distributor 32, are closed allowing only cell 1*c* to fill. After a suitable time has elapsed and a suitable pressure reached within the cell (about 4 sec. and about 40 mmHg) valve 50 closes and valve 52 opens (FIG. 6). With valve 52 open cell 2*c* is filled. Next, cell 3*c* is filled (FIG. 7) and finally cell 4*c* (FIG. 8).

Figure 9:
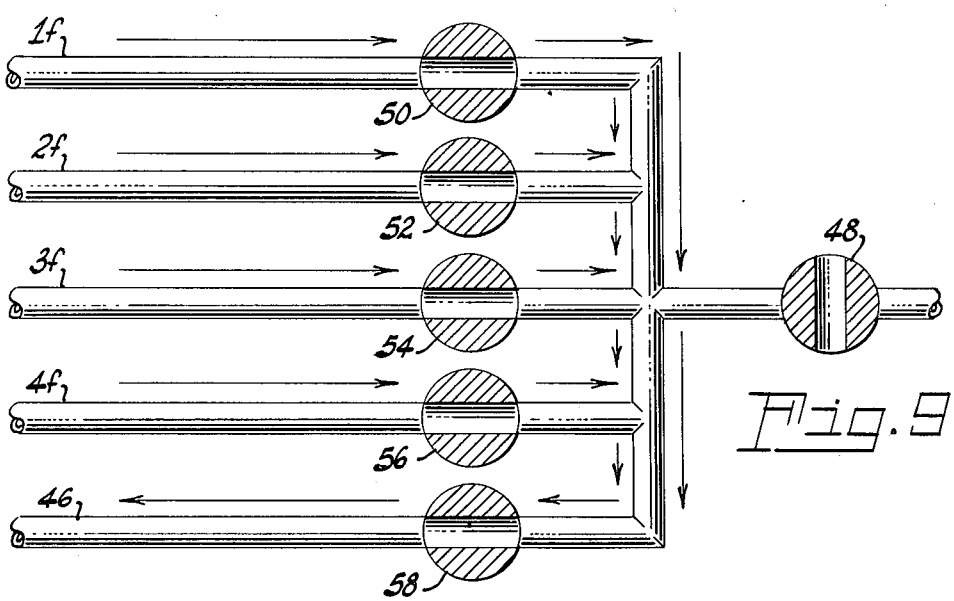
Figure 10:
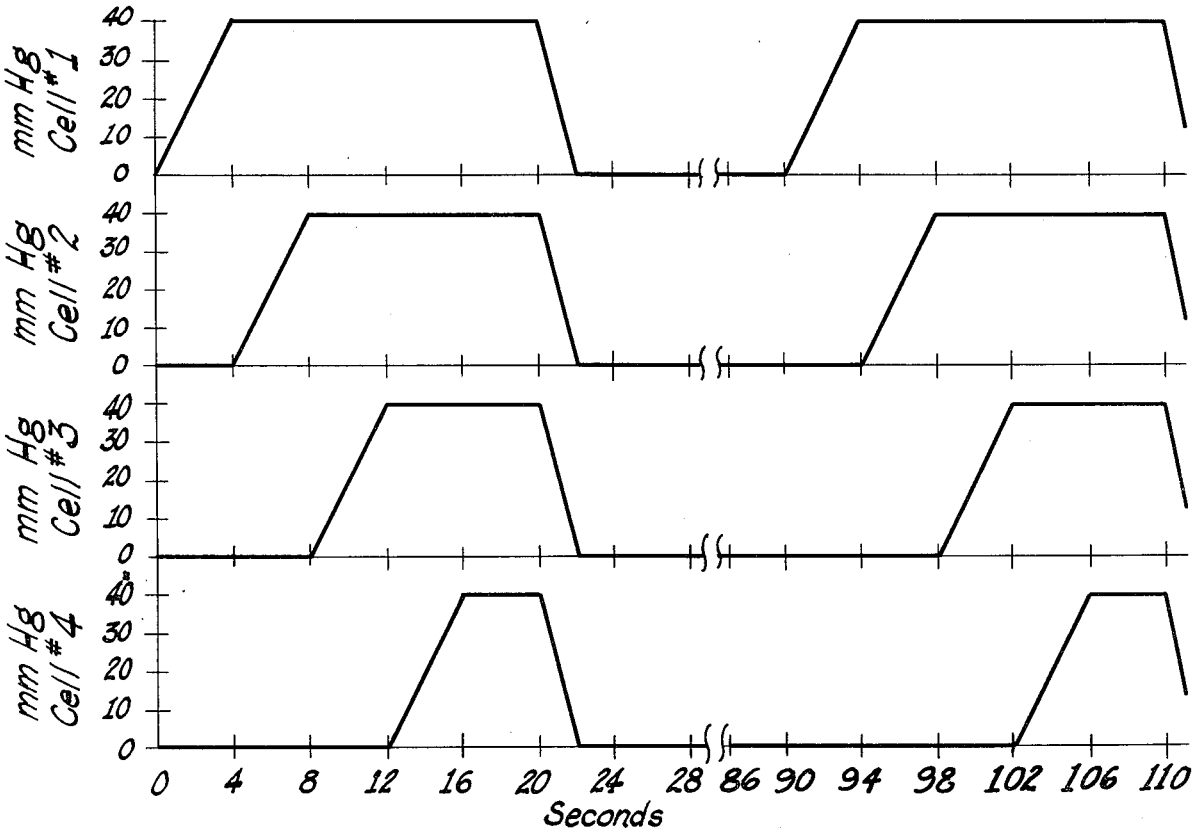
FIG. 10 is a graphic chart of the pressurization, exhaust and ventilation sequences and times.
Figure 11:
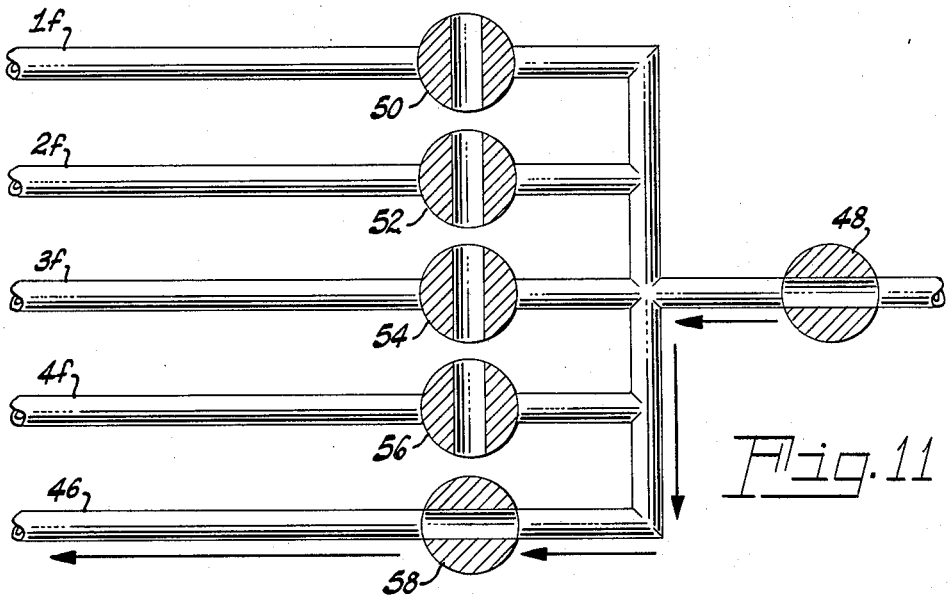

The graph of FIG. 10 illustrates the filling cycle and it can be seen therefrom that all of the cells are filled in approximately 16 seconds, held at pressure for about four additional seconds and then simultaneously dumped or exhausted. The exhaust position of the valves is shown in FIG. 9 whereat supply valve 48 closes and valves 50, 52, 54, 56 and 58 open. In this circumstance the pressured air from cells 1*c*–4*c* flows back though distributor 32, through valve 58 through hose 46 to exhaust manifold 44 and thence to ventilating cells 1*v*, 2*v* and 3*v* whereat the air is vented through pin hole apertures 30 to ventilate the area between the pad 22 and the patient. As seen from the graph, the dumping or exhaust takes about 2 seconds. Ventilation for the entire down time of the cells is then provided by closing valves 50, 52, 54 and 56 and opening supply valve 48 while keeping valve 58 open (FIG. 11). This allows the air to be pumped continuously through exhaust manifold 44 and cells 1*v*–3*v* until the cycle is ready to be repeated. A complete cycle of pressurization, exhaust and ventilation takes approximately one and one half minutes. At the end of one and one half minutes the pressurization begins again, as shown in FIG. 10.

The above described procedure for supplying ventilation is the preferred one since it is eminently workable and inexpensive; however, for providing continuous ventilation a dual supply could be provided and the pressurized cells could be fed thereinto or exhausted to atmosphere. Such an alternate is shown in system FIGS. 12 and 13.

Figure 12:
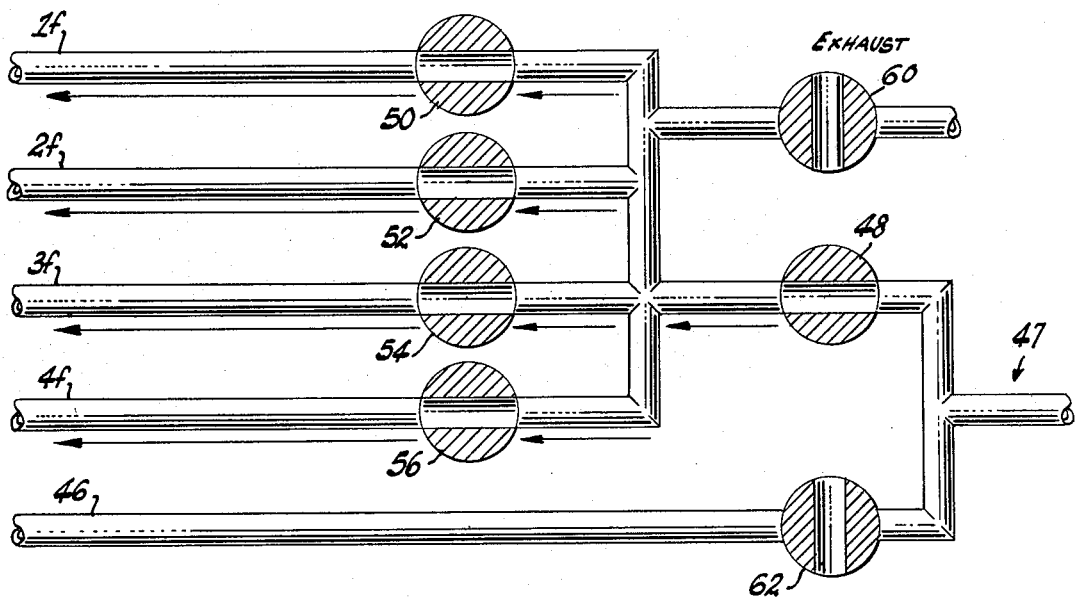
FIGS. 12 and 13 are schemmatic representations of an alternate valving system.
Figure 13:
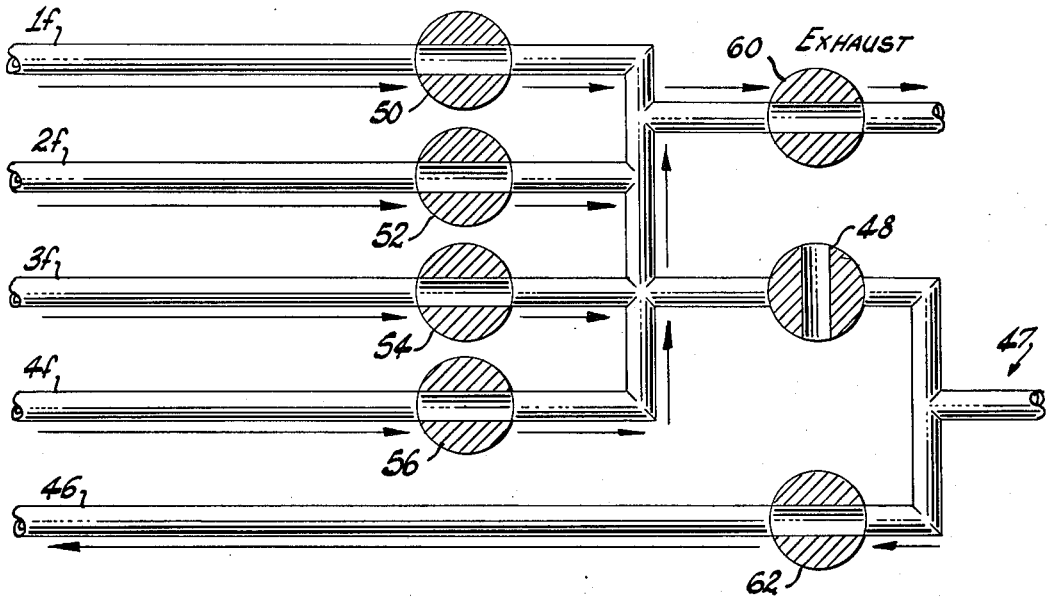

Referring specifically to FIG. 12, there is shown a system at its final stage of filling. The cells have been filled sequentially, but the individual fill valves 50, 52 etc. have been left open as their respective cells have been filled. This keeps a constant supply of pressure thereinto. An additional exhaust valve 60 is provided and is vented to atmosphere. Further, the fluid supply 47 is distributed between cell filling valve 48 and ventilating valve 62. As illustrated in FIG. 12 valve 48 is open as are valves 50, 52, 54 and 56. At the end of the filling cycle valve 48 closes and valves 60 and 62 open (FIG. 13). This allows the cells 1*c*, 2*c*, 3*c* and 4*c* to vent to atmosphere directly through valve 60 without exhausting through the ventilating cells. Ventilation is supplied directly to the ventilating cells via fluid supply 47 and open valve 62. This system is preferred when the pressure in the cells 1*c*, 2*c*, 3*c* and 4*c* may not be sufficiently high to totally exhaust through the ventilating cells.

The pad and system herein provided achieves great success in the alleviation of operative and post operative DVT. The sequential filling of the cells from the ankle upward toward the calf has a massaging or squeezing effect upon the veins which increase venous blood flow towards the heart much better then systems which supply pressure over the entire lower leg.

It should also be noted that while the system has been discribed herein as relating to a cuff which encompasses a lower leg, there is no reason why the cuff could not be made large enough to cover the leg from ankle to groin.

While there has been shown and described what are at present considered to be the preferred embodiments of the invention, it will be apparent to those skilled in the art that various changes and modifications can be made herein without departing from the scope of the invention as defined by the appended claims.

What is claimed is:

1. An apparatus for the alleviation of operative and post operative deep venous thrombosis comprising a flexible pad formed for external enwrappment about a mammalian limb, said pad comprising: a first plurality of relatively large, individual fluid receiving cells, said first cells being formed to receive and hold sufficient fluid to exert pressure upon said limb for a given period of time and to subsequently release said fluid; a second plurality of relatively smaller cells arrayed alternately with said first plurality of cells, said second plurality of cells being formed to receive and continuously release a supply of ventilating fluid; and means for supplying said fluid to said cells.

2. The apparatus of claim 1 wherein each of said first plurality of individual cells has a given width and a length greater than said width, the length of said cells wrapping circumferentially about the circumference of said limb.

3. The apparatus of claim 2 wherein said length of each of said first plurality of cells is different, said differences being formed to at least approximately accommodate the various circumferences of said mammalian limb.

4. The apparatus of claim 2 wherein each of said cells of said first plurality of cells has a first end formed to receive said fluid pressure.

5. The apparatus of claim 4 wherein said cells are physically connected together for about one half their length.

6. The apparatus of claim 4 wherein said means for supplying said fluid pressure to said first plurality of individual cells of said pad does so in a predetermined sequence.

7. The apparatus of claim 6 wherein said means for supplying said fluid pressure includes means for exhausting said fluid pressure.

8. The apparatus of claim 7 wherein said means for exhausting said fluid pressure includes means for directing said exhausted fluid pressure to said second plurality of cells.

9. The apparatus of claim 7 wherein said predetermined sequence comprises sequentially filling said first plurality of individual cells substantially one at a time beginning with the distal cell thereof and exhausting said cells simultaneously.

10. The apparatus of claim 9 wherein said pad is formed from two overlying sheets of fluid impervious material.

11. The apparatus of claim 10 wherein said individual cells are formed in said sheets by means of dielectric welds.

12. The apparatus of claim 11 wherein said pad is provided with a plurality of fastening means for retaining said pad in said wrapped position on said mammalian limb.

13. The apparatus of claim 9 wherein said fluid is a pressurized gas and said exhausted fluid is fed to the area between said limb and said pad by means of said second plurality of cells whereby ventilation is provided.

14. The apparatus of claim 13 wherein the side of said second plurality of cells facing said limb is provided with a multiplicity of pin hole apertures.

15. A device for applying compressive pressures against a patient's limb from a source of pressurized fluid, comprising:

an elongated pressure sleeve for enclosing a length of the patient's limb, said sleeve having a plurality of laterally extending separate fluid pressure chambers progressively arranged longitudinally along the sleeve from a lower portion of the limb to an upper portion of the limb proximal the patient's heart relative to said lower portion, and ventilation means comprising a plurality of laterally extending ventilation channels having a width substantially less than the width of said chambers, with said ventilation channels having opening means for facing the patient's limb, and with said ventilation channels being located intermediate different pairs of adjoining pressure chambers, and said ventilation means having a connecting channel extending along the side of said pressure chambers and communicating with said ventilation channels; and control means for intermittently inflating and deflating said pressure chambers and for passing air into the ventilation means to ventilate the patient's limb through said opening means.

16. The device of claim 1 wherein said control means inflates said compression chambers during periodic compression cycles and deflates the chambers during periodic decompression cycles between said compression cycles.

17. The device of claim 2 wherein the control means passes air into the ventilation means during the decompression cycles.

18. The device of claim 1 wherein the control means includes means for selectively permitting and preventing passage of air into the ventilation means.

19. The device of claim 1 wherein said ventilation chambers are spaced along a substantial distance of the patient's limb.

20. An elongated sleeve for applying compressive pressures against a patient's limb, comprising:

a pair of flexible sheets of fluid impervious material;

means for connecting said sheets together along lines defining a plurality of separate laterally extending inflatable pressure chambers progressively arranged longitudinally along the sleeve from a lower portion of the limb to an upper portion of the limb proximal the patient's heart relative to said lower portion and defining a plurality of laterally extending ventilation channels having a width substantially less than the width of said chambers, and a connecting channel communicating with the ventilation channels, with said ventilation channels being located between different pairs of adjoining pressure chambers and having opening means for facing the patient's limb, and with said connecting channel extending along the side of the inflatable pressure chambers; and means for releasably securing the sleeve about the patient's limb with said pressure chambers and ventilation channels encircling the limb.

* * * * *

Disclaimer 4,453,538.—*John K. Whitney,* Orchard Park, N.Y. MEDICAL APPARATUS. Patent dated June 12, 1984. Disclaimer filed Dec. 6, 1985, by the assignee, *Gaymar Industries, Inc.*

Hereby enters this disclaimer to claims 15, 16, 17, 18, 19 and 20 of said patent.

[*Official Gazette February 3, 1987.*]